United States Patent [19]

Lingnau

[11] Patent Number: 4,668,600

[45] Date of Patent: May 26, 1987

[54] ELECTROPHOTOGRAPHIC RECORDING MATERIAL CONTAINING AN N-TYPE CONDUCTING PIGMENT

[75] Inventor: Jürgen Lingnau, Mainz, Fed. Rep. of Germany

[73] Assignee: Hoechst Aktiengesellschaft, Frankfurt am Main, Fed. Rep. of Germany

[21] Appl. No.: 732,702

[22] Filed: May 10, 1985

[30] Foreign Application Priority Data

May 15, 1984 [DE] Fed. Rep. of Germany ..... 3417951

[51] Int. Cl.[4] ..... G03G 5/06

[52] U.S. Cl. ..... 430/83; 430/96

[58] Field of Search ..... 430/58, 70, 73, 75, 430/79, 82, 83, 96

[56] References Cited

U.S. PATENT DOCUMENTS

| | | | |
|---|---|---|---|
| 3,037,861 | 6/1962 | Hoegl et al. | 96/1 |
| 3,112,197 | 11/1963 | Neugebauer et al. | 96/1 |
| 3,121,006 | 2/1964 | Middleton et al. | 96/1 |
| 3,180,729 | 4/1965 | Klupfel et al. | 96/1 |
| 3,189,447 | 6/1965 | Neugebauer et al. | 96/1 |
| 3,238,150 | 3/1966 | Behringer et al. | 252/501 |
| 3,244,517 | 4/1966 | Lind | 96/1 |
| 3,257,203 | 6/1966 | Sues et al. | 96/1.5 |
| 3,816,118 | 6/1974 | Byrne | 96/1.5 |
| 3,870,516 | 3/1975 | Smith et al. | 96/1.5 |
| 3,871,882 | 3/1975 | Wiedemann | 96/1.5 |
| 3,877,935 | 4/1975 | Regensburger et al. | 96/1.5 |
| 3,879,200 | 4/1975 | Regensburger et al. | 96/1.5 |
| 3,904,407 | 9/1975 | Regensburger et al. | 96/1.5 |
| 4,063,948 | 12/1977 | Lind | 96/1.6 |
| 4,278,747 | 7/1981 | Murayama et al. | 430/75 |
| 4,301,224 | 11/1981 | Kozima et al. | 430/58 |
| 4,315,981 | 2/1982 | Wiedemann | 430/59 |
| 4,418,134 | 11/1983 | Patel et al. | 430/88 |
| 4,463,077 | 7/1984 | Matsuura et al. | 430/76 |
| 4,525,444 | 6/1985 | Doessel | 430/96 |

FOREIGN PATENT DOCUMENTS

| | | |
|---|---|---|
| 0137217 | 4/1985 | European Pat. Off. . |
| 49-76933 | 11/1972 | Japan . |
| 50-38543 | 8/1973 | Japan . |
| 944126 | 12/1963 | United Kingdom . |
| 1416603 | 12/1975 | United Kingdom . |

*Primary Examiner*—John L. Goodrow

*Attorney, Agent, or Firm*—Schwartz, Jeffery, Schwaab, Mack, Blumenthal & Evans

[57] ABSTRACT

An electrophotographic recording material is disclosed comprising an electrically conductive support, a photoconductive layer and, optionally, an insulating barrier layer between the substrate and photoconductive layer. The photoconductive layer comprises at least one organic, n-type conducting pigment in a concentration between 10 and 50, preferably between 15 and 30, percent by weight, relative to the photoconductive layer weight, at least one electronically inert, carbonyl group-containing binder and an organic, p-type conducting photoconductor in a concentration from 0 to 20, preferably from 2 to 8 percent by weight, relative to the photoconductive layer weight. The n-type conducting pigment preferably comprises a compound selected from the trans-perinones, the perylene-tetracarboxylic acid diimides, and the condensed quinones.

18 Claims, No Drawings

ELECTROPHOTOGRAPHIC RECORDING MATERIAL CONTAINING AN N-TYPE CONDUCTING PIGMENT

BACKGROUND OF THE INVENTION

The present invention relates to an electrophotographic recording material comprising an electrically conductive support, a photoconductive layer and, optionally, an insulating barrier layer between the support and the photoconductive layer. The recording material is suitable for repeated or single use in copiers, and for use as a printing plate or a printed circuit.

German Auslegeschrift No. 11 17 391 (corresponding to British Pat. No. 944,126) discloses the manufacture of electrophotographic recording materials, using photoconductive, predominantly low-molecular weight, organic p-type conducting compounds which are sensitized in the visible region of the spectrum by means of (a) suitable, dissolved dyes, as described in German Offenlegungsschrift No. 25 26 720 (corresponding to U.S. Pat. No. 4,063,948), or (b) dispersed photoconductive color pigments, as described in German-Auslegeschrift No. 21 08 939 (corresponding to U.S. Pat. No. 3,870,516).

As the charge-carrier generating color pigments, perinones, as specified in German Offenlegungsschrift No. 22 39 923 (corresponding to British Pat. No. 1,416,603) and in German Offenlegungsschrift No. 21 08 958 (corresponding to U.S. Pat. No. 3,879,200), perylene tetracarboxylic acid diimides, as specified in German Offenlegungschriften No. 22 37 539 (corresponding to U.S. Pat. No. 3,871,882) and No. 21 08 992 (corresponding to U.S. Pat. No. 3,904,407), and condensed quinones, as specified in German Offenlegungsschriften No. 22 37 678 (corresponding to U.S. Pat. No. 4,315,981) and No. 21 08 935 (corresponding to U.S. Pat. No. 3,877,935) are used, among others. The above-described systems have in common a double layer arrangement comprised of a thin charge-carrier generating bottom layer containing a high concentration of color pigment and a relatively thick charge transport layer containing an inert biner and an organic p-type conducting photoconductive.

Layer arrangements are also disclosed in which the sensitizing color pigment and the p-type conducting photoconductor are applied, together in one layer, to the electrically conductive support. According to U.S. Pat. No. 3,879,200, for example, the concentration of color pigment required to achieve optimum physical and electrical properties amounts to only 0.1 to 5% by volume of the photoactive layer. On the other hand, the organic p-type conducting photoconductor, comprising aromatic or heterocyclic compounds, must be present in the layer in a concentration of at least 25% by volume, to obtain practicable sensitivities. The binders which are described include electronically inert polymers, such as polystyrene, polyacrylate, cellulose nitrate, polyvinyl acetate, chlorinated rubber, etc.

Moreover, electrophotographic layers are known, which comprise a photoconductive pigment and an electronically inert binder. As the photoconductive pigments, zinc oxide, according to U.S. Pat. No. 3,121,006, cadmium sulfide, according to U.S. Pat. No. 3,238,150, and a number of other inorganic compounds are described. In these layers, charge transport is achieved by a high concentration of the photoconductive pigment. A layer composition of this kind requires a pigment concentration exceeding 50% by volume to permit contact between the photoconductive particles. According to German Offenlegungsschrift No. 32 27 475 (corresponding to U.S. Pat. No. 4,418,134), organic photoconductive pigments can be substituted for part of the inorganic pigment, and for this purpose, pigments such as C.I. Pigment Red 168 and C.I. Pigment Orange 43, which represent derivatives of naphthalene tetracarboxylic acid diimides, have proved suitable. The total proportion of photoconductor in the layer, which is necessary for practical application, is then in the range between 20 and 80% by weight. In view of an application in electrophotographic offset-printing plates, polymers which are decoatable with or dispersible in alkaline solutions are required as the binders.

Because light absorption and charge-carrier generation occur, in particular, in the upper region of the layer, and because transport characteristics are different for electrons and "holes" ("n-type photoconductors"), a good sensitivity of zinc oxide layers is only observed if a negative charge is applied. With positive charging, on the other hand, good sensitivities are obtained in monolayer photoconductor systems which contain, in addition to an inert binder, a metal-free phthalocyanine in the X-form (see German Offenlegungsschrift No. 14 97 205, corresponding to U.S. Pat. No. 3,816,118). The required pigment concentration between 5 and 25% by weight is clearly below the value assumed for contact between the pigment particles.

In an analogous manner, monolayers for positive charging can be prepared from copper phthalocyanine in the $\epsilon$-form (Japanese patent application No. 50/38543, published after examination).

From Japanese patent application No. 49/76933, published after examination, it is known that the pigment C.I. Pigment Orange 43 (=C.I. Vat Orange 7) can be converted into a photoconductive form by reacting it with 2,4,7,8-tetranitrocarbazole. The resulting $\pi$-complex shows good sensitivities in combination (50:50) with poly-N-vinyl-carbazole as a binder having the properties of a p-type conducting photoconductor.

To achieve high photosensitivities in the case of negative charging, photoconductors in double-layer arrangement are used. But this arrangement has the disadvantage of being produced in two steps of coating application, which is more expensive than the production of a monolayer material. Double-layer arrangements also have the disadvantage of showing an unfavorable residual-charge behavior. Monolayers based on zinc oxide, on the other hand, have low residual charge potentials and can be used for cyclic image reproduction. But due to the high proportion of zinc oxide, layers of this kind show a relatively low mechanical stability and a relatively poor charge acceptance.

Decoatability of the photoconductor layer in the non-image areas, after imaging and fixing the toner image, is a decisive criterion of usefulness in the production of electrophotographic printing plates or printed circuits. As a consequence, photoconductive layers in double layer arrangements containing extremely high pigment proportions are not readily employed in this context. According to published European Patent Application EP-A- No. 0 137 217, double layer photoconductors which are formed of two layers of approximately equal thickness, i.e., a precoating comprising a pigment and a binder and a covering coating comprising a p-type conducting photoconductor and a binder, can be used for the electrophotographic production of offset printing plates, but they are clearly less sensitive than the first-mentioned photoconductor layers, and are also unfavorable from the point of view of production expense.

Monolayer photoconductors containing dissolved sensitizing dyes, as disclosed by German Offenlegungsschrift No. 25 26 720 (corresponding to U.S. Pat. No. 4,063,948), have similar sensitivities but, in contrast to the pigment layers, are sensitive to pre-exposure, i.e., their charge acceptance is noticeably impaired by preliminary exposure. Monolayers containing low concentrations of sensitizing pigments show photosensitivities which are markedly lower than those of double layers and also poorer image reproductions. all of the above-described layer arrangements, however, exhibit unwelcome, relatively large residual potentials after exposure, which potentials rise drastically with increasing layer thickness and lead to difficulties in rendering visible the latent charge image.

For use as electrophotographic resists, monolayers comprising a binder, a dissolved dye or pigment, and a p-type conducting photoconductor are only applicable by laminating processes. Because of the high proportion of photoconductor in such layers, direct application to metals, such as copper or iron, often leads to contamination of the layer or surface and, thus, to a considerably reduced charge acceptance which severely hampers practical use. By means of double layer which do not contain a p-type conducting photoconductor in the pre-coating, these effects can be obviated, but the above-mentioned disadvantage thus appear.

SUMMARY OF THE INVENTION

It is therefore an object of the present invention to provide an electrophotographic recording material which can be used for the production of both printing plates and printed circuits (circuit boards), but which incorporates a low concentration of the p-type conducting photoconductor with a specific class of binder material.

It is another object of the present invention to provide an electrophotographic recording material which can be easily and inexpensively produced, which shows a high photosensitivity and high voltage contrasts, at a good negative charge acceptance, and which retains low residual potentials after exposure.

It is a further object of the present invention to provide an electrophotographic recording material having the properties set out in the preceding paragraph that also incorporates a flexible support and can be used in a lamination process.

In accomplishing the foregoing objects, there has been provided, in accordance with one aspect of the present invention, an electrophotographic recording material comprising an electrically conductive support and a photoconductive layer, wherein said photoconductive layer comprises (a) at least one organic, n-type conducting pigment in a concentration between about 10 and 50 percent by weight, relative to the layer weight of the photoconductive layer, (b) at least one electronically inert, carbonyl group-containing binder, and (c) an organic, p-type conducting photoconductor in a concentration from about 0 to 20 percent by weight, relative to the layer weight of the photoconductive layer. In one preferred embodiment, the aforesaid binder comprises a copolymer comprised of a methacrylic acid ester and methacrylic acid.

Other objects, features, and advantages of the present invention will become apparent from the following detailed description. It should be understood, however, that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

An organic p-type conducting photoconductor can be homogeneously distributed in the photoconductive layer of the present invention. The photoconductor can also be distributed through the photoconductive layer in a gradient resulting from diffusion of the photoconductor into the layer, or in a stepped distribution resulting from a double layer arrangement.

As suitable n-type conducting pigments, compounds corresponding to the following general formulas I to IV can be used:

trans-perinones:

(I)

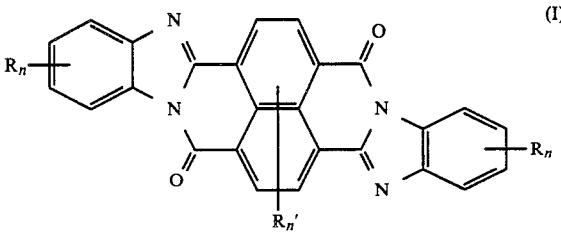

perylene tetracarboxylic acid diimides:

(II)

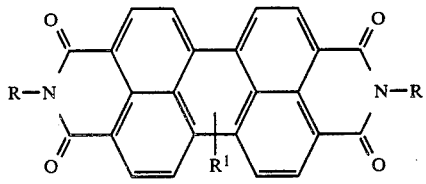

condensed quinones:

(III)

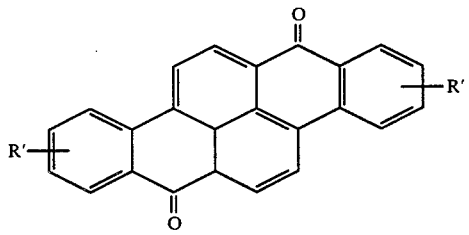

(IV)

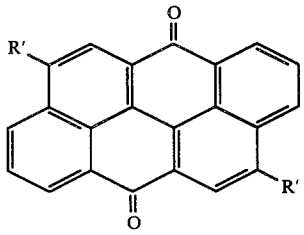

in which

R denotes a hydrogen, a phenyl radical or an alkyl radical having from one to four carbon atoms, which may be substituted by halogen, an alkyl group or an alkoxy group, R′ stands for halogen, such as chlorine or bromine, for the nitro group, the cyano group, or an alkoxy group, and n is an integer between one and four.

In a number of publications, these pigments are referred to as being photoconductive. In this context, however, "photoconductivity" is invariably understood as being based on interaction with other photoconductors. The color pigments thus play the role of a sensitizer which generates charge carriers in interaction with the p-type conducting photoconductor. Accordingly, pigments are either used in very thin, charge-carrier generating layers or, in the case of homogeneous distribution, in a relatively low concentration. According to U.S. Pat. No. 3,879,200 and No. 3,904,407, good electrophotographic properties can only be achieved when these conditions are met.

But, to the contrary, it has now been found, in accordance with the present invention, that recording materials containing pigments represented by formulas I to IV in sufficiently high concentrations (which approximate those described for the phthalocyanines of German Offenlegungsschrift No. 14 97 205, mentioned above) are photoconductive even if a p-type conducting photoconductor has not been added to the layer. Widely varying behavior observed with positive and negative charging, respectively, indicates a pronounced n-type conductivity for these pigments. As in ZnO, good sensitivities can be achieved only with negative charging.

Based on what was known previously of the pigments which are used according to the present invention, it was unexpected to find a pronounced dependency of the electrophotographic properties of the layer on the binder employed. Thus, good sensitivities could only be obtained when binders were used which comprised a carbonyl group, for example, in the form of the carboxyl group. Nitrocellulose, on the other hand, which normally is a binder having particularly favorable electrophotographic properties, proved to be extremely unfavorable in the photoconductive layer of the present invention; the same was true, for example, for polystyrene. The influence of the binder remains undiminished even if, according to the present invention, p-type conducting photoconductors are added to the layer in the indicated quantities.

As in zinc oxide layers, a strong "trap" effect, occurring in the initial phase of discharge, is observed in part of the photoconductive layers of the present invention, leading to an S-shaped discharge curve instead of the approximately exponential discharge characteristic normally obtained in organic photoconductor systems (see, for example, German Pat. No. 22 37 539). This S-shaped discharge characteristic yields particularly high voltage contrasts in the region of average exposure energies. As a consequence, the photoconductive layers of the present invention can be used for the production of charge images and toner images which have a particularly steep gradation and a particularly high resolution.

Utilization of the n-type conductivity of pigments employed according to the present invention requires a minimum pigment concentration of approximately 10 percent by weight, based on the layer weight. Pigment concentrations which are too high lead to a deterioration of charge acceptance and, consequently, a pigment content of about 50 percent by weight is regarded as an approximate upper limit. Pigment concentrations between 15 and 30 percent by weight have proved to be particularly advantageous. These pigment concentrations, particularly concentrations in the upper end of the range, ensure decoatability of the photoconductive layer for application in making electrophotographically imageable printing plates and the like, if the alkali-soluble binders according to the present invention are employed.

When n-type conducting pigments are used in accordance with the present invention, an increase in sensitivity is obtained if minor amounts of p-type conducting photoconductors are added to the photoconductor layer. The p-type conducting photoconductor compounds that are customarily employed in electrophotographic layer are suitable in this regard. Examples of such compounds are oxdiazoles, oxozoles, aromatic amines, triphenyl methanes and hydrazones, and also polymeric compounds, such as polyvinyl-carbazole, as described, for example, in German Pat. No. 10 58 836, No. 10 60 260, No. 11 20 875, No. 11 97 325, No. 10 68 115, and No. 11 11 935.

In order to ensure good charge acceptance of the photoconductive layer, the concentration of the p-type conducting photoconductor should not exceed 20 percent by weight, based on the layer weight. Concentrations between 2 and 8 percent by weight have proved particularly favorable.

The p-type conductivity of the photoconductor contributes to charge-carrier generation and transport of positive charge carrier only in the upper region of the photoconductor layer. According to the present invention, the addition of p-type conducting photoconductor can therefore be limited to these upper zones, and the addition of p-type conducting photoconductor in the upper layer region has proved advantageous too, particularly in the case of thicker layers. A systematic introduction of the p-type conducting photoconductor into the upper layer regions can be achieved either by a double layer arrangement or by post-treating the final layer, which does not yet contain the p-type conducting photoconductor, with corresponding solutions of the photoconductor, which are applied without binder. By partially dissolving the binder and then diffusing the p-type conducting photoconductor into the upper region of the layer, photosensitivities are obtained that correspond to the photosensitivities of homogeneously doped layers. Five percent strength solutions, for example, in tetrahydrofuran, have proved suitable for application.

Polymers with C═O-containing side groups, and also polycondensates and polyaddition compounds having C═O groups in the principal chain, are suitable as the electronically inert, carbonyl group-containing binders in the present invention. Good photosensitivities are achieved using homopolymers and copolymers of vinyl esters, of acrylic acid esters and methacrylic acid esters, of acrylic acid and methacrylic acid, of vinyl ketones, of acrylic acid amides and methacrylic acid amides, and also using polyesters, polycarbonates, polyurethanes, polyamides and polyureas. Due to their mechanical properties, polyesters and polycarbonates are particularly suitable for use in flexible photoconductors.

For the production of printing plates, electronically inert, carbonyl group-containing binders are used in the present invention which are soluble or dispersible in aqueous-alkaline solutions. For this purpose, it is preferred to use copolymers of methacrylic acid esters and methacrylic acid, optionally with additional monomers, such as acrylic acid and styrene. These copolymers have proved superior to alkali-soluble binders based on acrylic acid and acrylic acid esters or on vinyl acetate and crotonic acid, respectively. In particular, charge acceptance is higher in the preferred copolymers, while photosensitivity is unchanged; but these copolymers are also superior with regard to the criteria of fixability of the toner image obtained on the photoconductive layer, decoatability, and subsequent print run. Copolymers displaying a glass transition temperature of >40° C. are particularly advantageous for the production of printing plates.

For use in an electrophotographic dry resist, only those binders are suitable that have a substantially lower glass transition temperature. Only when the glass transition temperature is substantially lower than 40° C. can a complete transfer by lamination of the photoconductive layer be achieved. Binders which have proved particularly suitable include copolymers obtained from the monomers selected from acrylic acid, longer-chain acrylic acid esters and methacrylic acid esters, in combination (when appropriate) with additional monomers, such as methacrylic acid and styrene. For an application in the form of a liquid resist, there are no limitations concerning the glass transition temperature of the binder.

The thickness of the photoconductive layer depends, in the first instance, on the intended use. In order to ensure sufficient charge acceptance, the layer weight should not be below about 3 g/m$^2$. For use as a liquid resist or for the production of electrophotographic printing plates, the layer weight is appropriately between about 5 and 30 g/m$^2$, for photoconductor webs or drums in copiers between about 10 and 20 g/m$^2$, and for a laminatable material between about 20 and 50 g/m$^2$. A steep rise of the residual potential with increasing layer weight is not observed with the present invention.

Coating with the photoconductive layer is carried out in the usual manner, using a solution which is applied, for example, by doctor blade or spray coating. The coating solution is preferably applied by means of a flow coater. Drying of the layer is carried out, for example, in drying channels.

For a dry-resist application, the recording material according to the present invention can be produced in such a way that the photoconductive layer which is present on an intermediate support, for example, a polyethylene terephthalate film, is laminated under heat and pressure to the electrically conductive support. Due to the relatively low content of p-type conducting photoconductor, the recording material of the present invention can also be supplied in the form of a support and a coating solution for application to the support as a liquid resist. It is then left to the user to effect coating according to a wipe-on process.

Layers of little thickness serve as the insulating barrier layers. For this purpose, polymers, such as UV-curable or thermally curable systems, can be used that produce an improved adhesion of the photoconductive layer to the support material. The barrier layers can also comprise insulating metal oxide layers, for example, aluminum oxide layers, by which the support surface is rendered hydrophilic. To ensure good electrophotographic properties, the layer weight of the insulating barrier layer should not exceed 4 g/m$^2$.

As the electrically conductive supports, metals and also plastic materials metallized by vacuum metallization or lamination can be used. In addition, it is possible to use plastics provided with conductive coatings comprising polymeric binders and conductive materials, such as metal powders or graphite dust. In the production of electrophotographic printing plates, the preferred supports comprise aluminum sheets which have been roughened and anodically oxidized. For use as an electrophotographic resist, the preferred support is comprised of copper or has a copper surface, such as a copper-clad polyamide film.

As the customary additives, which can be present in the photoconductive layer in a quantity of up to 5 percent by weight, the layer contains substances which are added to the coating solution. Such additives improve the surface texture and flexibility of the layer and include, for example, plasticizers, such as triphenyl phosphate, and levelling agents, such as silicone oils.

The present invention is explained in detail by the following examples and comparative examples, which are intended to be illustrative only and in no sense limiting.

EXAMPLE 1

An electrochemically pre-heated and anodically oxidized aluminum web, of the type used as a support for an offset-printing plate, was coated with the following dispersion to produce a dry layer weight of 6 g/m$^2$: 15.0 g of N,N'-dimethylperylene-3,4,9,10-tetracarboxylic acid diimide (C.I. 71,130, formula II) were added to a solution of 10.0 g of a copolymer of vinyl acetate and crotonic acid (Mowilith Ct 5 ®, manufactured by Hoechst AG) in 200 g of tetrahydrofuran and were dispersed by milling in a ball mill for 2 hours. The resulting mixture was thereafter admixed with 10 g of 2,5-bis-(4-dimethylaminophenyl)-oxadiazole-1,3,4, 0.1 g of a silicone oil having a viscosity from 5 to 20, mPa.s, and with 65.0 g of the above-mentioned copolymer in 700 g of tetrahydrofuran.

The layer obtained after drying was deep-red and had a matte appearance. The data obtained therefor are listed in the table below.

EXAMPLE 2

15.0 g of Hostaperm Orange GR (Pigment Orange 43, C.I. 71,105, formula I) were added to a solution of 10 g of polybutyl methacrylate (200 Plexigum P 676, manufacturers Roehm GmbH) in 200 g of tetrahydrofuran and were dispersed by milling in a ball mill for 2 hours. After adding 3 g of 2,5-bis-(4-diethylaminophenyl)-oxidazole-1,3,4 and 32 g of polymethyl methacrylate (Plexigum M 345 ®, manufacturers Roehm GmbH) in 340 g of tetrahydrofuran, the layer was applied to a polyethylene terephthalate film, which had been vacuum metallized with aluminum to produce a layer weight of 6 g/m$^2$. The layer was then dried.

EXAMPLE 3

The procedure of Example 2 was followed, with the difference that the indicated oxidazole was replaced by 1,5-diphenyl-3-p-methoxyphenyl-pyrazoline, according to German Auslegeschrift No. 10 60 714 (corresponding to U.S. Pat. No. 3,180,729), and instead of polybutyl methacrylate and polymethyl methacrylate, a terpolymer of styrene, hexylmethacrylate and methacrylic acid in a molar ratio of 10:60:30 was used. The layer was coated on a roughened and anodically oxidized aluminum support material to give a layer weight of about 6 g/m$^2$.

After charging and imagewise exposing, the layer was treated with a dry developer. After fixing, the layer could be decoated without background via a commercially available decoating solution. The offsetprinting plate thus obtained showed a high resolution and, when used in a printing test, yielded good printing qualities up to a print run of well over 100,000 copies.

EXAMPLE 4

The procedure of Example 3 was followed, with the difference that 4-methoxybenzaldehyde-diphenylhydrazone (German Offenlegungsschrift No. 32 46 036) was used instead of pyrazoline and, as the dye, N,N'-(3-methoxypropyl)-perylene-tetracarboxylic acid-3,4,9,10-diimide (Paliogen-Black®, manufacture by BASF AG) was used instead of Hostaperm Orange GR.

EXAMPLE 5

20.0 g of N,N'-dimethylperylene-3,4,9,10-tetracarboxylic acid diimide (C.I. 71,130, formula II), as indicated in Example 1, were added to a solution of 20 g of a polycarbonate (Makrolon 2405®, manufactured by Bayer AG) in 200 g of tetrahydrofuran and were dispersed in a ball mill for 2 hours. The dispersion was thereafter applied to a polyethylene terephthalate film which had been vacuum metallized with aluminum to give a dry layer weight of 6 g/m$^2$.

EXAMPLE 6

The procedure of Example 1 was followed, with the difference that the layer applied to the support had a layer weight of 20 g/m$^2$.

Although the layer weight had been increased by a factor of 3.3, a higher residual potential was not observed after exposure to white light at an energy of 30 $\mu$J/cm$^2$.

EXAMPLE 7

The procedure of Example 3 was followed, with the difference that a copper-clad polyimide film was used instead of the anodically oxidized aluminum support. The contamination effects observed in photoconductor monolayers containing higher proportions of photoconductor, as disclosed, for example, by European patent application EP-A- No. 0 137 217, which lead to a considerable reduction of charge acceptance, were not observed with the low concentrations of dissolved photoconductor used in this example. After the coated film thus obtained has been imaged and the toner image fixed, the film could be perfectly decoated in the areas not covered by the toner. By etching away the metal areas lying underneath, high-quality flexible circuit boards were obtained.

EXAMPLE 8

As described in the preceding examples, a layer comprising 25% by weight of Hostaperm Orange GR and 75% of the terpolymer of Example 3 was first applied to an anodically oxidized aluminum support to give a layer weight of 3 g/m$^2$. This base layer was coated with a layer comprising 25% by weight of Hostaperm Orange GR, 20% by weight of 2,5-bis-(4-diethylaminophenyl)-oxadiazole-1,3,4 and 55% by weight of the above-indicated terpolymer, providing a layer weight of 3 g/m$^2$.

EXAMPLE 9

According to Example 8, a precoating (base layer) having a layer weight of 6 g/m$^2$ was applied to an anodically oxidized aluminum support. The dried layer was then treated with a solution of 5% by weight of 2,5-bis-(4-diethylaminophenyl)-oxidazole-1,3,4 in tetrahydrofuran and again dried. Corresponding results are obtained by treating the still moist precoating with an oxdiazole solution ("wet-in-wet coating").

EXAMPLE 10

The procedure of Example 2 was followed, with the difference that, instead of the methacrylates, a polyester (Dynapol L 206®, manufactured by Dynamit Nobel AG) was used. The material thus obtained had a high flexibility and the layer adhered well to the support. Even when used in cyclically operating copiers, the electrophotographic properties of the material did not change with the number of charging and exposure cycles.

EXAMPLE 11

The procedure of Example 2 was followed, with the difference that the terpolymer was replaced by a polyurethane (Desmolac 2100®, manufactured by Bayer AG).

EXAMPLE 12

The procedure of Example 2 was followed, with the difference that polyvinylcarbazole (Luvikan®, manufactured by BASF AG) was used as the photoconductor and N,N'-dimethylperylene-3,4,9,10-tetracarboxylic acid diimide as the pigment.

EXAMPLE 13

The procedure of Example 2 was followed, with the difference that Hostaperm Scarlet GO (C.I. 59,300, formula IV) was used as the pigment.

EXAMPLE 14

The procedure of Example 2 was followed, with the difference that indanthrene golden-yellow-RK (formula III, R=Br) was used as the pigment; the photoconductor content amounted to 20% by weight.

EXAMPLE 15

The procedure of Example 2 was followed, with the difference that a compound corresponding to formula I, R=$NO_2$, was used as the pigment; the photoconductor content amounted to 20% by weight.

COMPARATIVE EXAMPLE 1

A solution comprised of (a) 50 g of a copolymer of styrene and maleic anhydride, decomposition point 200° to 240° C., (b) 50 g of 2,5-bis-(4-diethylaminophenyl)-oxdiazole-1,3,4 dissolved in 900 g of tetrahydrofuran, with an addition of 0.1 g of silicone oil, and (c) 0.5 g of Rhodamine B (C.I. 45,170) dissolved in 5 g of methanol was applied to a roughened and anodically oxidized aluminum support for printing plates. The resulting layer was then dried.

COMPARATIVE EXAMPLE 2

The following dispersion was applied to a roughened and anodically oxidized aluminum support for printing plates, such that a dry layer weight of 3 g/m$^2$ resulted: 50 g of a copolymer of styrene and maleic anhydride were dissolved in 950 g of tetrahydrofuran, with an addition of 0.1 g of silicone oil, and 2 g of N,N'-dimethylperylene-3,4,9,10-tetracarboxylic acid diimide C.I. 71,130) were dispersed in the solution by milling in a ball mill for 2 hours. After drying, this charge carrier-generating layer was coated with a charge transport layer, also having dry layer weight of 3 g/m$^2$, produced from the following solution: 50 g of a copolymer of styrene and maleic anhydride and 50 g of 2,5-bis-(4-diethylaminophenyl)-oxdiazole-1,3,4 were dissolved in 700 g of tetrahydrofuran and 250 g of butyl acetate, with an addition of 0.1 g of silicone oil.

COMPARATIVE EXAMPLE 3

A monolayer having a layer weight of 6 g/m$^2$ was applied to a roughened and anodically oxidized aluminum support for printing plates from the following dispersion: 6.25 g of Hostaperm Orange GR and 4.2 g of the terpolymer of Example 3 were dispersed and dissolved, respectively, in 50 g of tetrahydrofuran by milling for 2 hours in a ball mill, and were then added to a solution of 50 g of 2,5-bis-(4-diethylaminophenyl)-oxidazole-1,3,4, 40 g of the terpolymer of Example 3 and 0.1 g of silicone oil in 850 g of tetrahydrofuran. This example corresponds to a sensitive monolayer formulation described in U.S. Pat. No. 3,879,200.

COMPARATIVE EXAMPLE 4

The procedure of Example 3 was followed, with the difference that the methacrylate terpolymer was replaced by a sulfonyl urethane which was also decoatable by means of aqueous-alkaline solutions (prepared according to German Offenlegungsschrift No. 32 10 577, Example 1).

COMPARATIVE EXAMPLE 5

The procedure of Example 2 was followed, with the difference that a cellulose nitrate having a degree of nitration of 12.2% was used instead of the methacrylates.

COMPARATIVE EXAMPLE 6

The procedure of Example 2 was followed, with the difference that polystyrene was used instead of the methacrylates.

COMPARATIVE EXAMPLE 7

The procedure of Example 3 was followed, with the difference that, instead of the trans-perinone Hostaperm Orange GR, the analogous cis-compound Permanent Red TGo1 (C.I. 71,110), manufactured by Hoechst AG, was used.

The results of electrophotographic investigations carried out on the layers prepared according to the above-described examples and comparative examples are compiled in the following table. In the table, $E_{\frac{1}{2}}$, $E_{\frac{1}{4}}$, and $E_{\frac{1}{8}}$ refer to the exposure energies which must be applied, at a light intensity of 3 $\mu$W/cm$^2$, to obtain a discharge from −400 V to −200 V, −100 V, and −50 V, respectively.

TABLE

| Exampl. No. | max. charge acceptance (V) | $E_{\frac{1}{2}}$ in $\mu$J/cm$^2$, halogen-tungsten lamp, heat absorption glass filter filtering out wavelengths beyond 700 nm | $E_{\frac{1}{4}}$ | $E_{\frac{1}{8}}$ | $U_e$ (V) after exposure to 30 $\mu$J/cm$^2$ |
|---|---|---|---|---|---|
| 1 | −430 | 1.76 | 2.59 | 3.76 | −11 |
| 2 | −650 | 6.44 | 7.23 | 9.27 | −15 |
| 3 | −604 | 6.0 | 7.0 | 10.0 | −31 |
| 4 | −400 | 1.98 | 3.43 | 7.24 | −19 |
| 5 | −590 | 4.11 | 6.07 | 15.01 | −31 |
| 6 | −540 | 1.66 | 2.24 | 3.11 | −11 |
| 7 | −650 | 5.8 | 6.7 | 9.2 | −25 |
| 8 | −600 | 6.48 | 7.10 | 8.06 | −15 |
| 9 | −650 | 5.11 | 6.00 | 6.90 | −7 |
| 10 | −500 | 4.44 | 5.60 | 7.28 | −7 |
| 11 | −600 | 5.0 | 6.4 | 7.6 | −11 |
| 12 | −460 | 4.63 | 9.54 | 20.3 | −27 |
| 13 | −600 | 7.7 | 11 | 20 | −11 |
| 14 | −220 | 1.22 | 2.03 | 4.16 | −11 |
| 15 | −180 | 5.8 | 7 | 9 | 0 |
| C1 | −800 | 9.3 | 20 | 45 | −80 |
| C2 | −650 | 4.5 | 11.7 | 24.7 | −40 |
| C3 | −660 | 9.4 | 13.4 | 18.4 | −35 |
| C4 | −520 | 17.9 | 44 | 85 | −150 |
| C5 | −367 | | | | −200 |
| C6 | −20 | | | | |
| C7 | −530 | 24.8 | 102 | — | −180 |
| comm. ZnO-printing plate | −440 | 3.06 | 3.63 | 4.26 | 0 |
| 3 | +440 | | | | +160 |

What is claimed is:

1. An electrophotographic recording material comprising an electrically conductive support and a photoconductive layer, wherein said photoconductive layer consists essentially of (a) at least one organic n-type conducting pigment in a concentration between about 10 and 50 percent by weight, relative to the layer weight of said photoconductive layer; (b) at least one electronically inert carbonyl group-containing binder; and (c) an organic p-type conducting photoconductor in a concentration from about 0 to 20 percent by weight, relative to the layer weight of said photoconductive layer, the concentration of said p-type conducting photoconductor being less than the concentration of said n-type conducting pigment, such that said recording material displays good sensitivity only with negative charging.

2. A recording material as claimed in claim 1, wherein said n-type conducting pigment is present in a concentration between about 15 and 30 percent by weight and said p-type conducting photoconductor is present in a concentration from about 2 to 8 percent by weight, relative to said layer weight.

3. A recording material as claimed in claim 1, wherein said n-type conducting pigment comprises a compound selected from the group consisting of a transperinone, a perylene-tetracarboxylic acid diimide and a condensed guinone.

4. A recording material as claimed in claim 1, wherein said n-type conducting pigment comprises Hostaperm Orange GR (C.I. 71,105).

5. A recording material as claimed in claim 1, wherein said n-type conducting pigment comprises N,N'-dimethylperylene,3,4,9,10-tetracarboxylic acid diimide (C.I. 71,130.

6. A recording material as claimd in claim 1, wherein said n-type conducting pigment comprises N,N'-bis-(methoxypropyl)-perylene-3,4,9,10-tetracarboxylic acid diimide.

7. A recording material as claimed in claim 1, wherein said carbonyl group-containing binder is soluble or dispersible in an aqueous alkaline solution.

8. A recording material as claimed in claim 7, wherein said carbonyl group-containing binder comprises a copolymer comprises of a methacrylic acid ester and methacrylic acid.

9. A recording material as claimed in claim 8, wherein said copolymer further comprises a monomer from the group consisting of acrylic acid and styrene.

10. A recording material as claimed in claim 8, wherein said carbonyl group-containing binder has a glass transition temperature above about 40° C.

11. A recording material as claimed in claim 1, wherein said support comprises aluminum.

12. A recording material as claimed in claim 2, wherein said support comprises aluminum.

13. A recording material as claimed in claim 1, wherein said support is comprised of copper or has a copper surface.

14. A recording material as claimed in claim 1, wherein said photoconductive layer was transferred from an intermediate support to the electrically conductive support by lamination under heat and pressure.

15. A recording material as claimed in claim 1 wherein said photoconductive layer comprises (1) a base layer comprised of an oganic n-type conducting pigment and an electronically inert binder and (2) a covering layer provided on said base layer and comprising an organic n-type conducting pigment, an electronically inert binder, and an organic p-type conducting photoconductor.

16. A recording material as claimed in claim 15, wherein said base layer and said covering layer, respectively, have layer weights in a ratio ranging between about 10:1 and 1:10.

17. A recording material as claimed in claim 1, further comprising an insulating barrier layer between said support and said photoconductive layer.

18. A recording material as claimed in claim 1, wherein said organic p-type conducting photoconductor is absent from said photoconductive layers.

* * * * *